United States Patent [19]

Davies et al.

[11] 4,114,872

[45] Sep. 19, 1978

[54] BLANK FEEDING

[75] Inventors: Robert William Davies; Peter Ernest Willett, both of London, England

[73] Assignee: Molins Limited, London, England

[21] Appl. No.: 800,495

[22] Filed: May 25, 1977

[30] Foreign Application Priority Data

May 28, 1976 [GB] United Kingdom ..... 22253/76
Dec. 10, 1976 [GB] United Kingdom ..... 51612/76

[51] Int. Cl.[2] ..... B65H 3/40

[52] U.S. Cl. ..... 271/91; 271/101; 271/106

[58] Field of Search ..... 271/91, 102, 95, 99, 271/100, 107, 102, 104, 106

[56] References Cited

U.S. PATENT DOCUMENTS

| | | | |
|---|---|---|---|
| 2,378,306 | 6/1945 | Leonhart | 271/102 X |
| 2,745,665 | 5/1956 | Labombarde | 271/106 X |
| 3,069,158 | 12/1962 | Engleson | 271/91 |
| 3,322,301 | 5/1967 | Bliss | 271/106 X |

*Primary Examiner*—Richard A. Schacher
*Attorney, Agent, or Firm*—John C. Smith, Jr.

[57] ABSTRACT

In apparatus for feeding blanks for hinged lid packets, the blanks are supported in a stack by two pairs of pivotal claws which operate alternately so that at any given time only one pair of opposed claws supports the stack. A plunger device, having a central and two tiltable outer sections, engages the lowermost blank by suction and bends down opposite ends of the blank through a small angle, thus progressively withdrawing the blank from the stack.

In a modification one pair of claws is replaced by fixed ledges, and a fixed finger is associated with each pivotal claw.

6 Claims, 10 Drawing Figures

BLANK FEEDING

This invention relates to the feeding of blanks from a stack, for example blanks which are to be formed into a packet, such as a hinged lid cigarette packet.

In machines for packing cigarettes in hinged lid packets it is usual to have a supply of packet blanks held in a stack and to remove the blanks singly from the stack at the rate at which packets are being formed. Commonly such removal is performed by a reciprocating plunger having rubber pads to which suction is selectively applied, the remaining blanks in the stack being held back by fixed ledges at the exit thereof.

A fault which may often occur in such an arrangement is that either the plunger fails to remove a blank from the stack or, alternatively, that more than one blank is removed, which could cause serious disturbances in subsequent sections of the packing machine. It may be possible to remedy this fault for a while, at least, by adjusting the fixed ledges at the exit of the stack. However, a change in the level of the stack (especially where the stack is vertically disposed) or a change in the batch of blanks may frequently cause a recurrence of the fault, usually requiring further adjustments of the ledges.

According to the invention we provide apparatus for feeding blanks from a stack, each blank being of substantially rectangular elongate shape and having a pair of short edge portions and a pair of long edge portions, comprising a plurality of retaining means at the exit of the stack engageable with edge portions of the lowermost blank at said exit, a plunger device movable into contact with the lowermost blank in a direction substantially perpendicular to the plane thereof, said plunger device having at least two tiltably inter-connected sections each of which has means for gripping an end part of the blank, and drive means operable to tilt one section relative to another so that opposed edge portions of said lowermost blank are progressively released from the remaining blanks in the stack, and operable then to withdraw said plunger device so as to separate said lowermost blank fully from the stack.

The retaining means may comprise a single pair of pivotally mounted claws engageable and disengageable with the short edge portions of a lowermost blank, there being provided fixed ledges at the long edge portions of the blank, which ledges may have inclined surfaces. A fixed finger may be associated with each pivotal claw to bear against the short edge portion and prevent two blanks being withdrawn from the stack at the same time.

The invention also extends to a method of feeding hinged lid blanks from a stack, the blanks having a pair of short edge portions and a pair of long edge portions by which the blanks are retained at the exit of the stack, in which each successive lowermost blank is withdrawn by the steps of gripping opposite end parts of the blank adjacent said short edge portions, tilting said opposite end parts to release the blank progressively from the remaining blanks, and then moving the blank substantially perpendicularly away from the remaining blanks.

For a better understanding of the invention, one embodiment and a modification thereof will now be described, by way of example only, with reference to the accompanying drawings in which.

Figure 2:
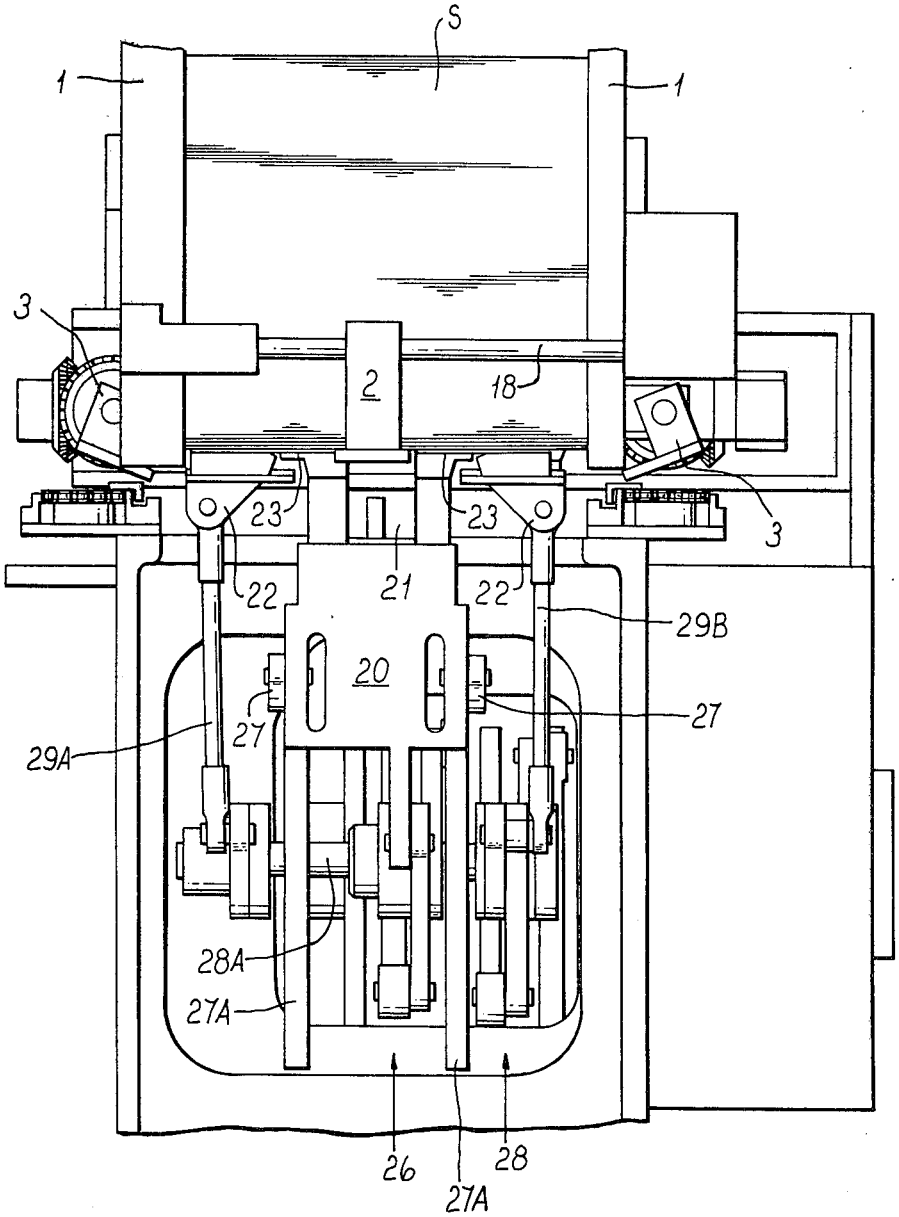
FIG. 2 is a front view taken in the direction of arrow II in FIG. 1.
Figure 3:
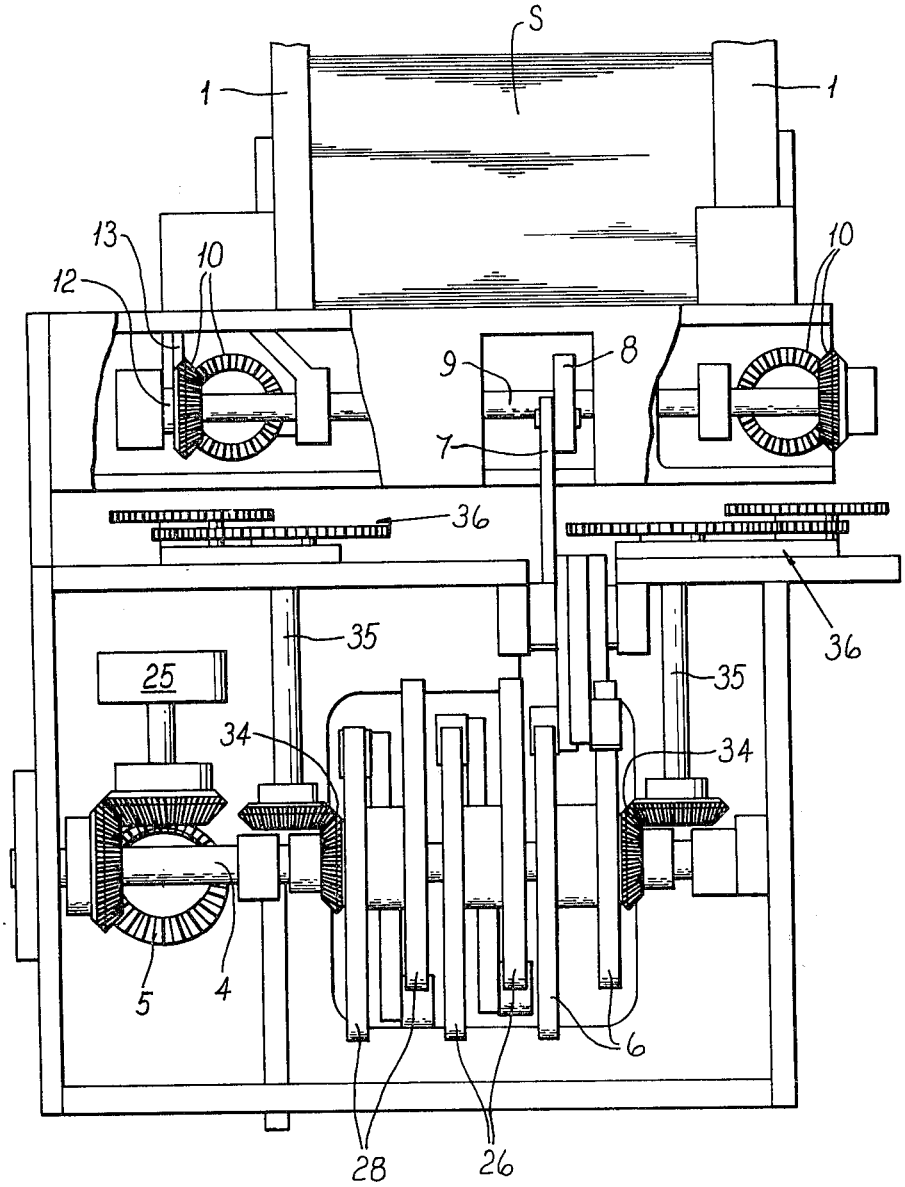
FIG. 3 is a rear view taken in the direction of arrow III in FIG. 1.
Figure 4:
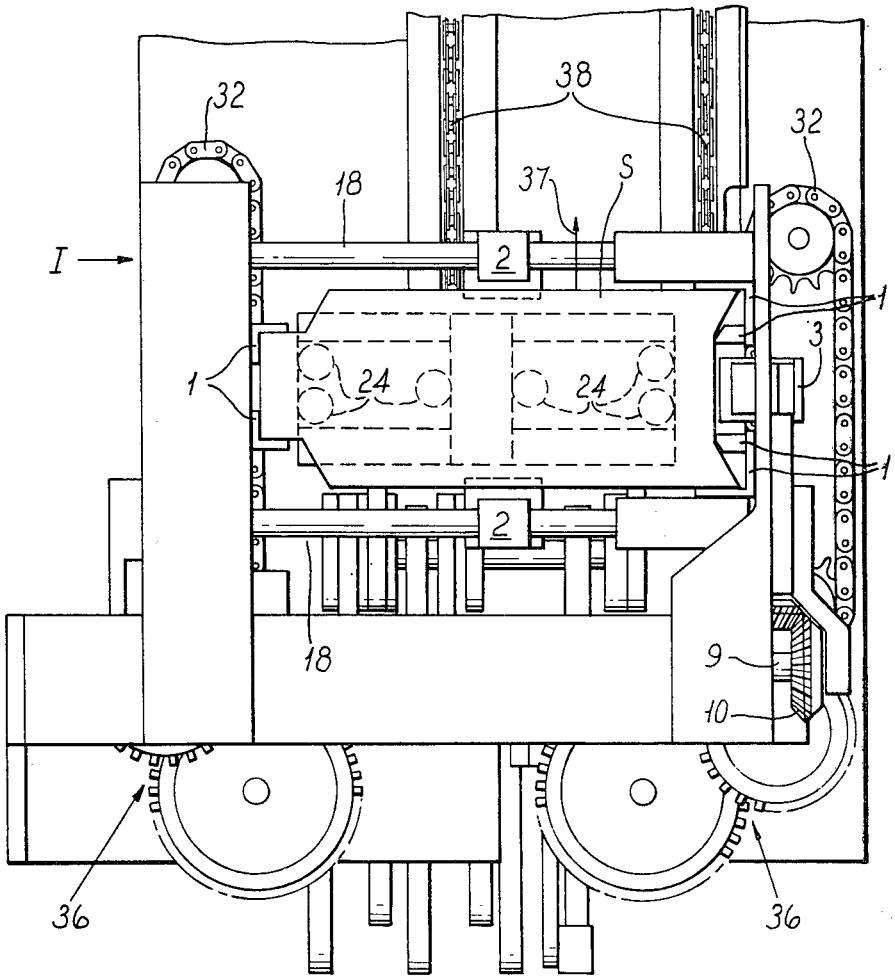
FIG. 4 is a plan view.

Referring first to FIGS. 1 to 4 of the drawings, there is shown at S a stack of blanks which are held in vertical alignment by guides 1. The blanks are for hinged lid packets, and have an elongated rectangular shape, as shown in FIG. 4, the corner edges of the stacks of blanks being shown engaged by the guides 1.

At the exit of the stack are two pairs of pivotally mounted claws 2 and 3. One pair of claws 2 are in engagement with the bottom of the stack, at the middle under the long marginal sides of the lowermost blank. The other pair of claws 3 are at the end of the lowermost blanks, and are shown in a disengaged position.

Figure 1:
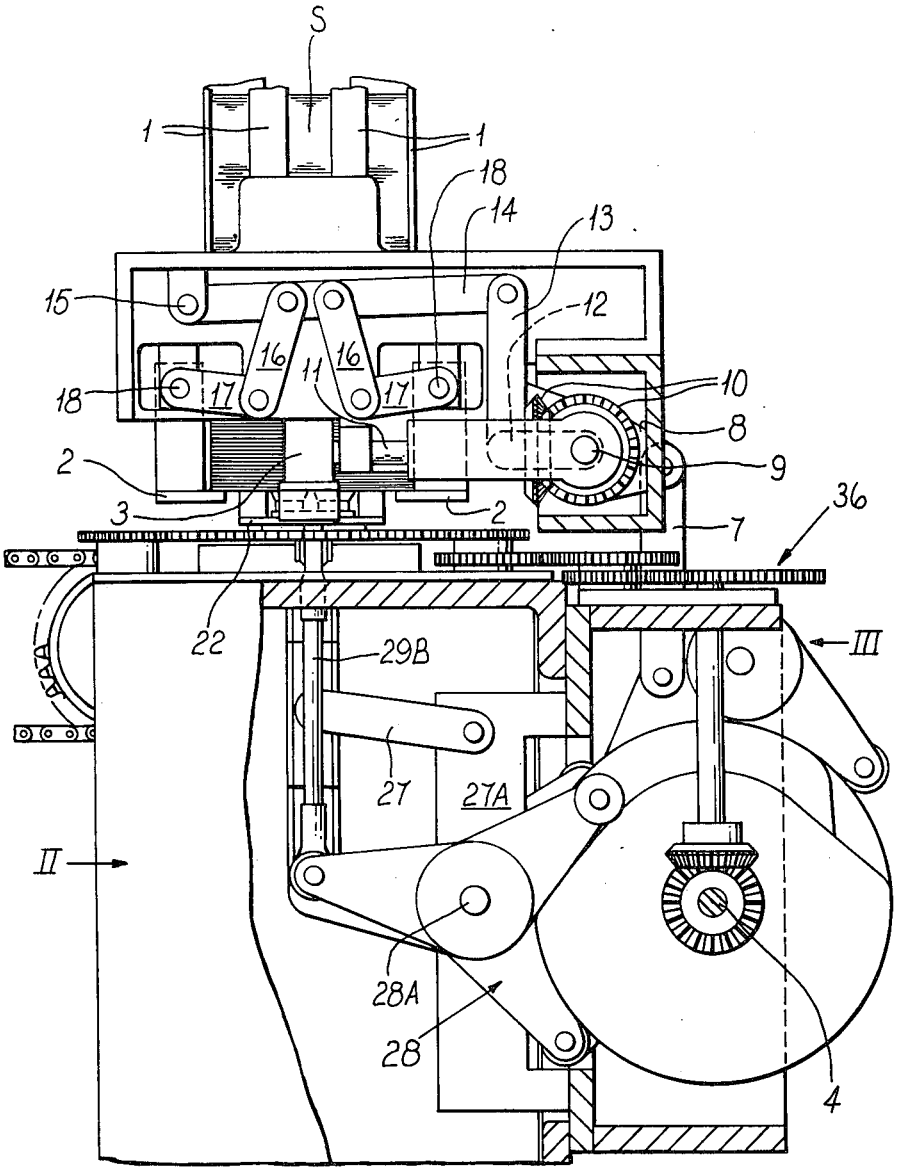
FIG. 1 is a side view of apparatus for feeding blanks from a stack, i.e. a view taken in the direction of arrow I in FIG. 4.

The mechanism for actuating the claws 2 and 3 can best be seen in FIGS. 1 and 3. A cam shaft 4 driven by a bevel gear 5 (FIG. 30 whose axis is inclined to the horizontal, carries three conjugate cams (each in fact comprising two cam members, in known manner), of which one cam 6 operates a vertical link 7. The link 7 is connected by a crank 8 to a shaft 9, whose ends are in turn connected through pairs of bevel gears 10 to shafts 11 on which the claws 3 are fixed. The shaft 9 is also connected through a crank 12 and a link 13 (FIG. 1) to one end of a bar 14, whose other end is pivoted about a fixed point 15. Two links 16 connect the central part of the bar 14 with a pair of cranks 17 each of which is secured to one end of a shaft 18 on which one of the claws 2 is fixed (see also FIG. 4).

When the conjugate cam 6 moves the link 7 upwards from the position shown, the shaft 9 rotates anticlockwise, as viewed in FIG. 1, causing the shafts 11 to rotate in opposite senses and bringing the claws 3 into a closed position to engage the lowermost blank of the stack S. Anticlockwise rotation of the shaft 9 also moves the link 13, the bar 14 and the links 16 in a generally downward direction, causing the shafts 18 to rotate in opposite senses to open the claws 2 and bring them out of engagement with the ends of the blank. Thus when one pair of claws is in the open position the other pair is in the closed position.

Figure 5:
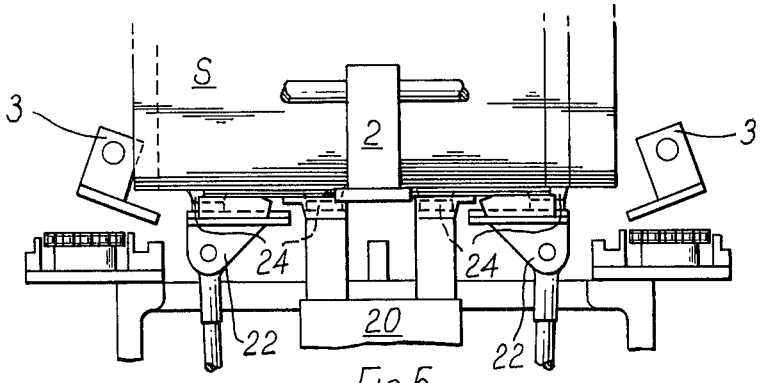
FIGS. 5 to 7 show the sequence of operations of part of the apparatus as viewed from the front.
Figure 6:
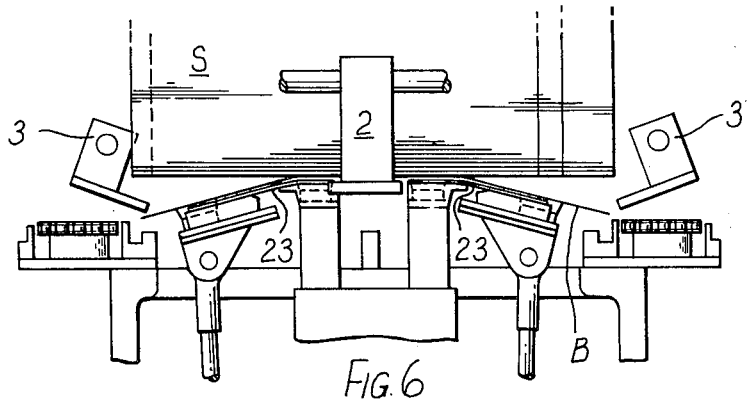

Referring now particularly to FIG. 2, beneath the stack of blanks is a vertically movable plunger device comprising a central plunger 20 consisting of two halves between which there is a gap 21, and a pair of end plungers 22 at opposite sides of the two halves of the central plunger. Each end plunger 22 is flexibly connected to the adjoining half of the central plunger 20 by a spring steel strip 23, enabling the end plungers to tilt by an angle of 15° or more (but not exceeding approx. 30°) as shown in FIG. 6. Each of the plungers 20 and 22 has a pair of rubber pads 24 (FIGS. 4 and 5) to which suction can be applied to grip the surfaces of the respective portions of the blank. The pads 24 are connected by flexible tubes (not shown) to a suction valve 25 (FIG. 3), which is driven through bevel gearing from the cam shaft 4 so that suction can be applied to the pads at the desired timing.

Vertical movement of the plunger 20 is controlled by a central conjugate cam 26, the plunger 20 being kept substantially vertically aligned by a pair of idle links 27 pivotal about fixed plates 27A. The third conjugate cam 28 operates through rods 29A and 29B to control movement, to be described below, of each of the end plungers 22. It may be noted that the right-hand rod 29B (as viewed in FIG. 2) is operated directly by the conjugate cam 28; however the lefthand rod 29A is operated via a shaft 28A (FIGS. 1 and 2), connected to the follower of the cam 28 and coaxial with the pivotal axis thereof, the shaft 28A passing through the pivotal axis of the follower of the central conjugate cam 26.

Figure 7:
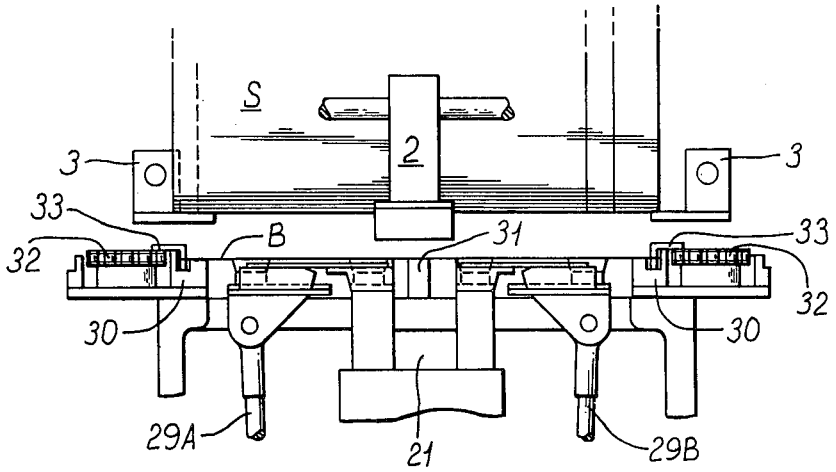

The operation of the apparatus so far described is as follows:

Beginning with the plungers 20 and 22 in their lower position and with the claws 2 and 3 in the position shown in FIG. 7, but with no blank on the plungers, the latter are first all moved to their upper position by the conjugate cams 26 and 28. When the pads 24 encounter the lowermost blank B in the stack S, suction is applied to the pads through the valve 25 to grip the blank. At the same time the cam 6 operates to reverse the positions of the claws so that the claws 3 are opened and the claws 2 are closed, as shown in FIG. 5. The cam 28 now starts lowering the end plungers 22, causing the spring strips 23 to flex and the end plungers 22 to become inclined relative to the central plunger 20, as shown in FIG. 6. The end portions of the lowermost blank are thus flexed downwards, and this flexing is believed to assist in progressively releasing any interlocking that may exist between the edges of internal cuts in the blank B being withdrawn and the corresponding edges of flaps in the next blank.

The cam 26 now causes the central plunger 20 to descend, so that the plungers 20 and 22 become aligned again (FIG. 7) by the time the blank B reaches a pair of end rails 30 and a middle rail 31, which is located in the gap 21 of the central plunger 20.

The mechanism for conveying blanks on the rails 30 and 31 consists of a pair of chains 32 each carrying a lug 33 (FIG. 7) which is movable along the respective rail 30. The drives to the chains 32 are from opposite sides of the cam shaft 4, each drive passing through a pair of bevel gears 34, a shaft 35 and a gear train 36 (FIG. 3).

As the blank B is deposited on the rails 30 and 31, the valve 25 cuts off suction to the pads 24, and the lugs 33 engage the rear corner edges of the blank B to slide it in the direction of arrow 37 (FIG. 4) away from the plungers 20 and 22.

The blank B is thus fed by the lugs 33 to a further chain conveyor 38 on which the blank is to commence being formed in stages into a hinged lid packet. When the blank is clear of plungers 20 and 22, the plungers are lifted by the cams 26 and 28 and recommence the cycle of operations described above.

The apparatus is capable of being adjusted to accommodate blanks of different sizes. Thus if the width of the blank is changed, the mountings (not shown) of the shaft 18 can be adjusted inwardly or outwardly so that the claws 2 still properly engage the marginal portions of the lowermost blank. If the length of the blank is changed, the claws 3 and associated shafts 11 can be adjusted by sliding the bevel gears 10 on shaft 9 in appropriate directions along splines (not shown) on the shaft 9. Alternatively the shaft 9 may be arranged to be split, so that it can be telescoped. The gear trains 26 are movably arranged so that the chains 32 and rails 30 can also be moved inwards or outwards to correspond with the new position of the claws 3. Additionally the distance between the plungers 22 can be changed by adjusting the two halves of the central plunger 20, thus altering the width of the gap 21.

Figure 8:
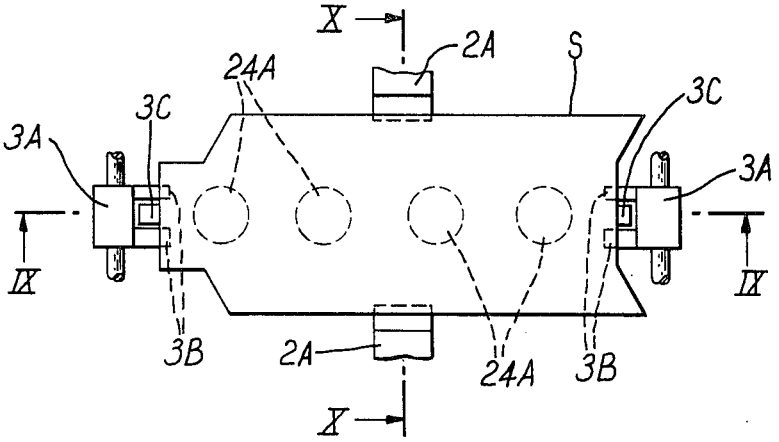
FIG. 8 is a modification of part of the apparatus shown in FIG. 4.
Figure 9:
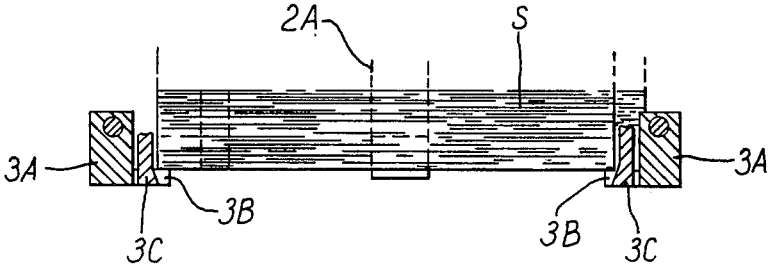
FIGS. 9 and 10 are sections taken on the lines IX and X respectively of FIG. 8.
Figure 10:
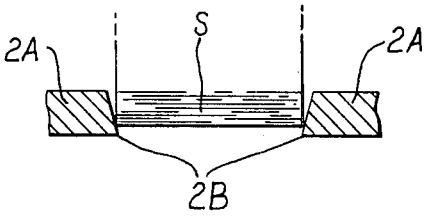

A modification of the apparatus is shown in FIGS. 8 to 10, in which modified parts are indicated by the previous reference numerals with the addition of suffix A.

A stack S of blanks is located, as previously, by guides (not shown in FIGS. 8 to 10). The central and end plungers are also not shown, but FIG. 8 shows the modified suction pads 24A in dotted lines. These are larger than the pads 24, and in the case of each end plunger there is only one pad 24A, instead of two pads as previously.

Referring particularly to FIG. 10, each long side of the bottom of the stack is engaged by a fixed claw or ledge 2A. The operative surfaces of the ledges 2A are steeply inclined, each terminating at a pointed lip 2B. Alternatively the ledges may be stepped, with more gently inclined operative surfaces (not shown).

The other pair of claws 3A are pivotally mounted, as previously, but have forked blank-engaging portions 3B. Between the forked portions 3B of each claw 3A is fixedly mounted a finger 3C, as best shown in FIG. 9. The ends of the fingers 3C are inclined to the vertical by an angle of about 10°, similar to the operative surfaces of the ledges 2A.

The operation of the modified apparatus is similar to that described above, as follows:

The plungers are raised to engage the lowermost blank, and suction is applied to the pads 24A. The claws 3A then open, allowing the end plungers to descend. As the extremities of the blank are flexed downwards, they bear against the inclined ends of the fingers 3C and are flicked off, thus preventing a second blank being withdrawn from the stack at the same time. The claws 3A next close, and the central plunger begins to descend to bring the end plungers into alignment therewith. The edges of the blank which bear against the ledges 2A similarly flick off the inclined surfaces at the lips 2B, so that at each descent of the central plunger only a single blank is withdrawn.

If desired the width of the fingers 3C may be increased, and the claws 3 omitted.

We claim:

1. Apparatus for feeding blanks from a stack, each blank being of substantially rectangular elongate shape and having a pair of short edge portions and a pair of long edge portions, comprising a plurality of retaining means at the exit of the stack engageable with edge portions of the lowermost blank at said exit, a plunger device movable into contact with the lowermost blank in a direction substantially perpendicular to the plane thereof, said plunger device having at least two tiltably inter-connected sections each of which has means for gripping an end part of the blank, and drive means operable to tilt one section relative to another so that opposed edge portions of said lowermost blanks are progressively released from the remaining blanks in the stack, and operable then to withdraw said plunger device so as to separate said lowermost blank fully from the stack, said plurality of retaining means comprising a first pair of pivotal claws disposed at opposite sides of said stack for engagement with said short edge portions of said lowermost blank, a second pair of pivotal claws disposed at opposite sides of said stack for engagement with said long edge portions of said lowermost blank, means for pivoting said first pair of claws out of engagement with said short edge portions prior to tilting of said sections of said plunger device by said drive means and for simultaneously pivoting said second pair of claws into engagement with said long edge portions, so that at any time only one of said first and second pairs of claws is in an engaged position.

2. Apparatus as claimed in claim 1, in which said plunger device comprises a central section and two outer sections tiltable about opposite sides of the central section, said outer sections gripping the respective end parts of the blank that are adjacent to said short edge portions.

3. Apparatus as claimed in claim 2, in which said central and outer sections are disposed in alignment during contacting of the lowermost blank.

4. Apparatus as claimed in claim 1, in which said means for gripping comprises a suction pad mounted on each section of the plunger device, the suction pads being operably connected to a source of suction.

5. Apparatus as claimed in claim 1, in which adjacent sections of the plunger device are tiltably connected by a strip of flexible material, and the drive means is arranged to produce an angle of tilt of each section not exceeding approximately 30°.

6. Apparatus as claimed in claim 1 in which said plurality of retaining means further comprises a fixed finger associated with each one of said first pair of pivotal claws, said fixed fingers having inclined surfaces which are mutually convergent in the direction of withdrawal of the plunger device.

* * * * *